United States Patent [19]

Mori

[11] 4,099,497

[45] Jul. 11, 1978

[54] INTERNAL COMBUSTION ENGINE HAVING EXHAUST EMISSION CONTROL SYSTEM

[75] Inventor: Haruo Mori, Tokyo, Japan

[73] Assignee: Fuji Jukogyo Kabushiki Kaisha, Tokyo, Japan

[21] Appl. No.: 639,159

[22] Filed: Dec. 9, 1975

[30] Foreign Application Priority Data

Dec. 26, 1974 [JP] Japan ..... 50/2336

[51] Int. Cl.[2] ..... F02P 5/04; F02M 25/06

[52] U.S. Cl. ..... 123/117 A; 123/119 A

[58] Field of Search ..... 123/117 A, 119 A

[56] References Cited

U.S. PATENT DOCUMENTS

| | | | |
|---|---|---|---|
| 3,712,279 | 1/1973 | Vartanian | 123/117 A |
| 3,774,583 | 11/1973 | King | 123/119 A |
| 3,812,831 | 5/1974 | Scott et al. | 123/117 A |
| 3,896,777 | 7/1975 | Masaki et al. | 123/119 A |
| 3,913,540 | 10/1975 | Hayashi | 123/117 A |
| 3,915,132 | 10/1975 | Thornburgh | 123/117 A |
| 3,924,589 | 12/1975 | Nohira et al. | 123/119 A |
| 3,962,868 | 6/1976 | Matumoto et al. | 123/117 A X |
| 3,977,373 | 8/1976 | Sand | 123/117 A |
| 3,978,831 | 9/1976 | Yoshikawa | 123/117 A |

*Primary Examiner*—Carlton R. Croyle
*Assistant Examiner*—Michael Koczo, Jr.
*Attorney, Agent, or Firm*—Martin A. Farber

[57] ABSTRACT

The characteristics of an exhaust emission control system can be varied by bleeding air into a vacuum conduit through which a vacuum is applied to a vacuum actuator in the exhaust emission control system. Means for bleeding air into the vacuum conduit includes at least one replaceable orifice. Another ambient air bleeding means comprises three plates which are joined face to face to one after another to form internal fluid connections between pressure and vacuum conduits through which intake passageway vacuum is applied to a vacuum actuator in an exhaust emission control system. One of the three plates is formed with a plurality of air bleed control orifices and can be easily replaced with another one.

10 Claims, 14 Drawing Figures

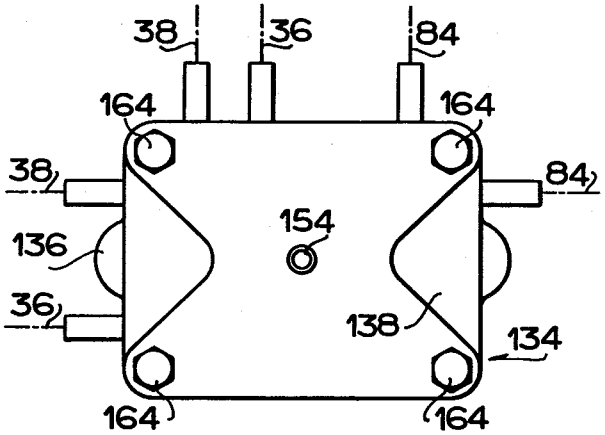
FIG. 4.
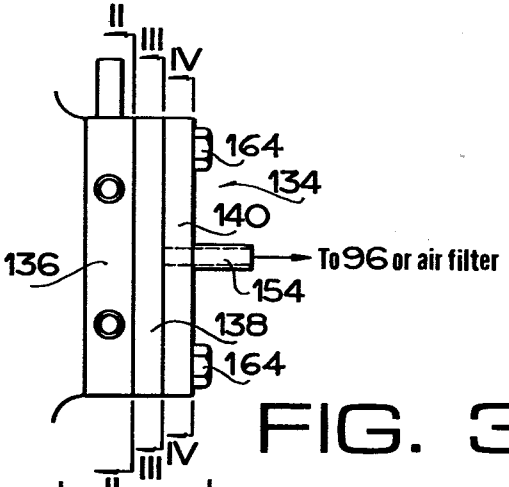
FIG. 3.
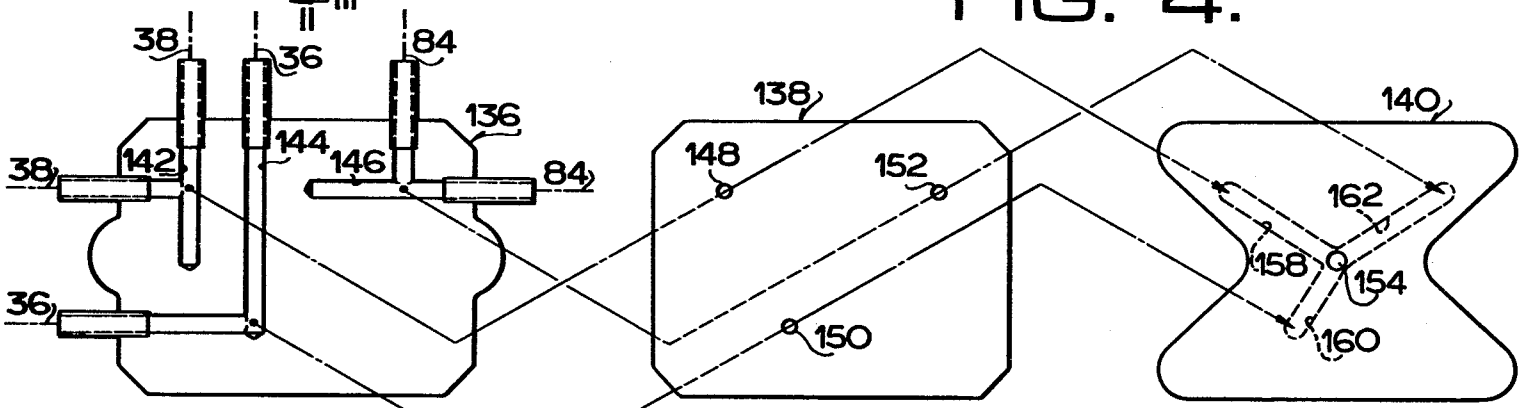
FIG. 5c.
FIG. 5b.
FIG. 5a.

INTERNAL COMBUSTION ENGINE HAVING EXHAUST EMISSION CONTROL SYSTEM

The present invention relates generally to an internal combustion engine having an exhaust emission control system, and more particularly to an internal combustion engine having a distributor with a vacuum spark timing control system and an exhaust gas recirculation system having a recirculation control device.

For the purpose of reducing exhaust emissions from an internal combustion engine it has heretofore been proposed to have the engine equipped with an exhaust emission control system. More particularly, the engine is equipped with a vacuum spark timing control device to advance or retard the spark timing, an exhaust gas recirculation apparatus having a vacuum operated recirculation control device, and conduit means connecting the spark timing control device and the recirculation control device to an intake passageway of the engine to apply the intake passageway vacuum to the spark timing control device and to the recirculation control device.

Upon installing the exhaust emission control system, the exhaust gas flow rates must be closely matched to nitrogen oxides ($NO_x$) control requirements and the spark timing to the actual engine requirements. The characteristics of the exhaust emission control system therefore must be altered by replacing components in dependency on the engine characteristics. Thus, the productivity of the engine equipped with an exhaust emission control system is worse than that of an engine without an exhaust emission control system due mainly to the fact that the replacement of components of the spark timing control device and of the recirculation control device are often necessary to match the system to the requirements.

It is an object of the present invention to provide an exhaust emission control system, the characteristics of which may be altered without replacement of those components which costs much.

It is a specific object of the present invention to provide an exhaust emission control system of the type including a vacuum spark timing control system to advance or retard the spark timing and an exhaust gas recirculation system having a recirculation control device, the characteristics of which system may be altered without replacement of components of the spark control system and of the recirculation control device.

It is another object of the present invention to provide means by which an exhaust emission control system may be easily altered in its characteristics.

These and other objects, features and advantages of the present invention will become apparent from the following description in connection with the accompanying drawings, in which:

FIG. 3 is a side view of an apparatus embodying the present invention and utilized to effect a fluid network for bleeding vacuum conduits in the exhaust gas control system shown in FIG. 1 or FIG. 2;

FIG. 4 is a plan view of the apparatus shown in FIG. 3;

Figure 1:
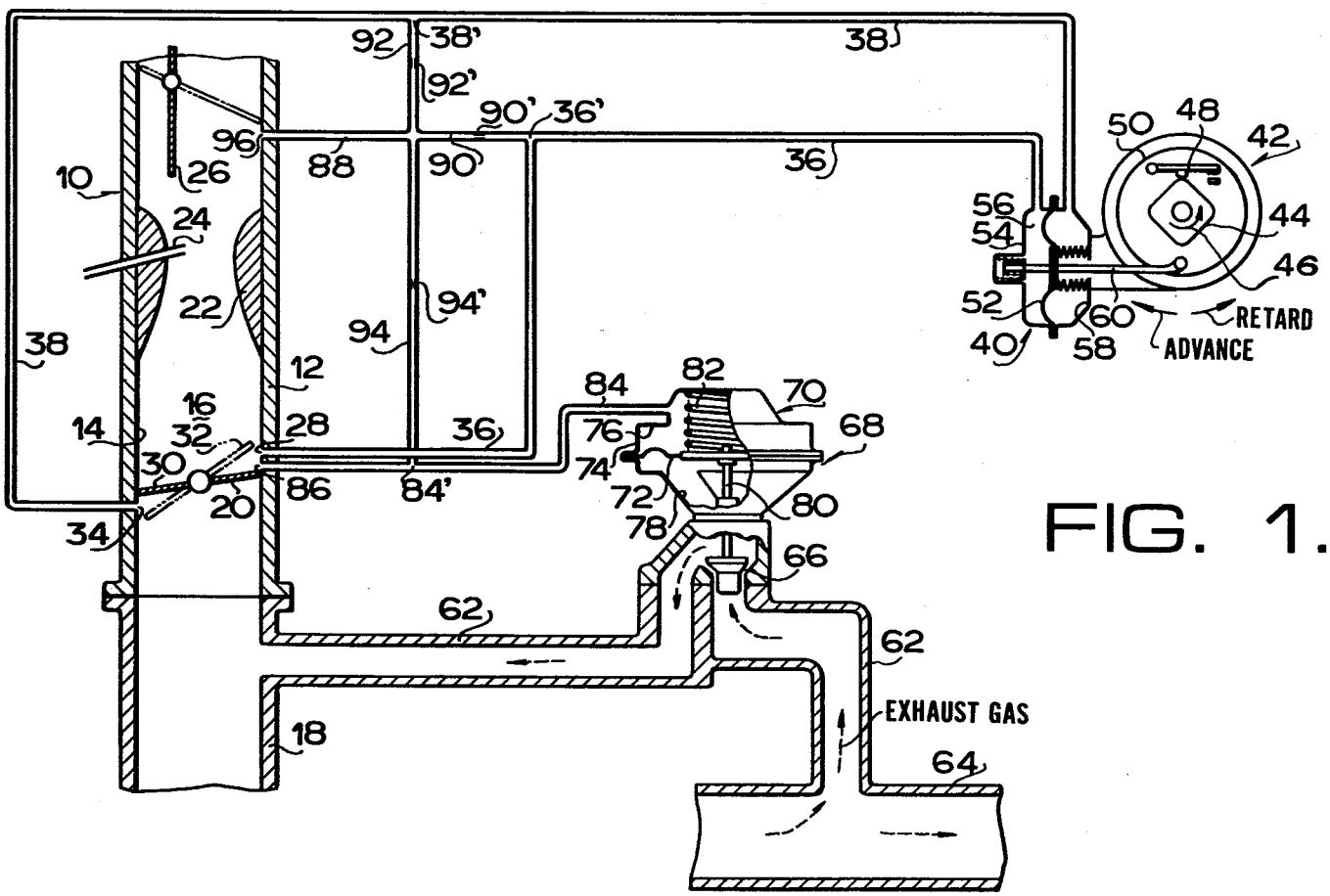
FIG. 1 is a schematic view of a portion of an internal combustion engine equipped with a preferred embodiment of an exhaust emission control system embodying the present invention.
Figures 6A, 6B, 6C, 7A, 7B, 7C:
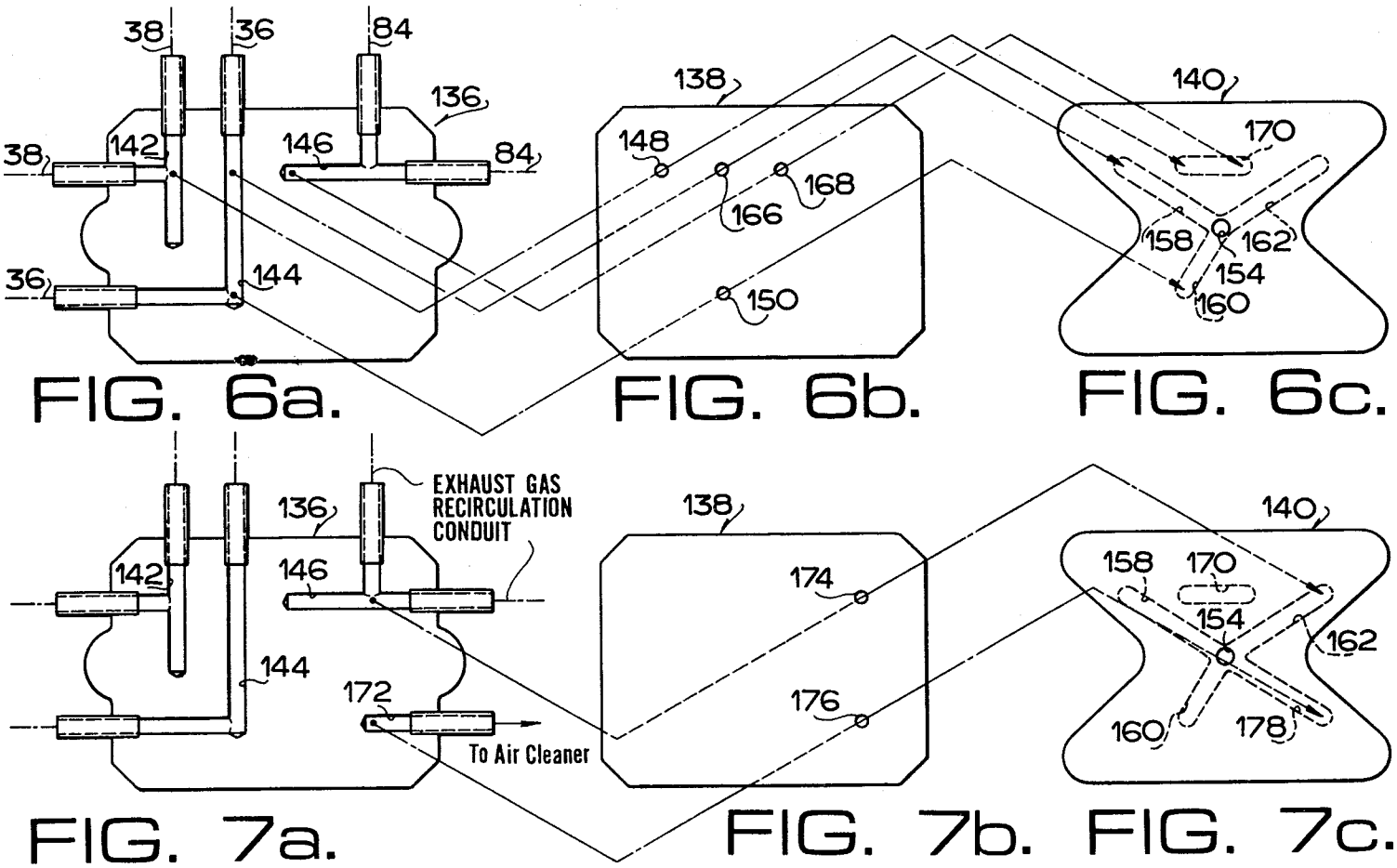
Figure 8:
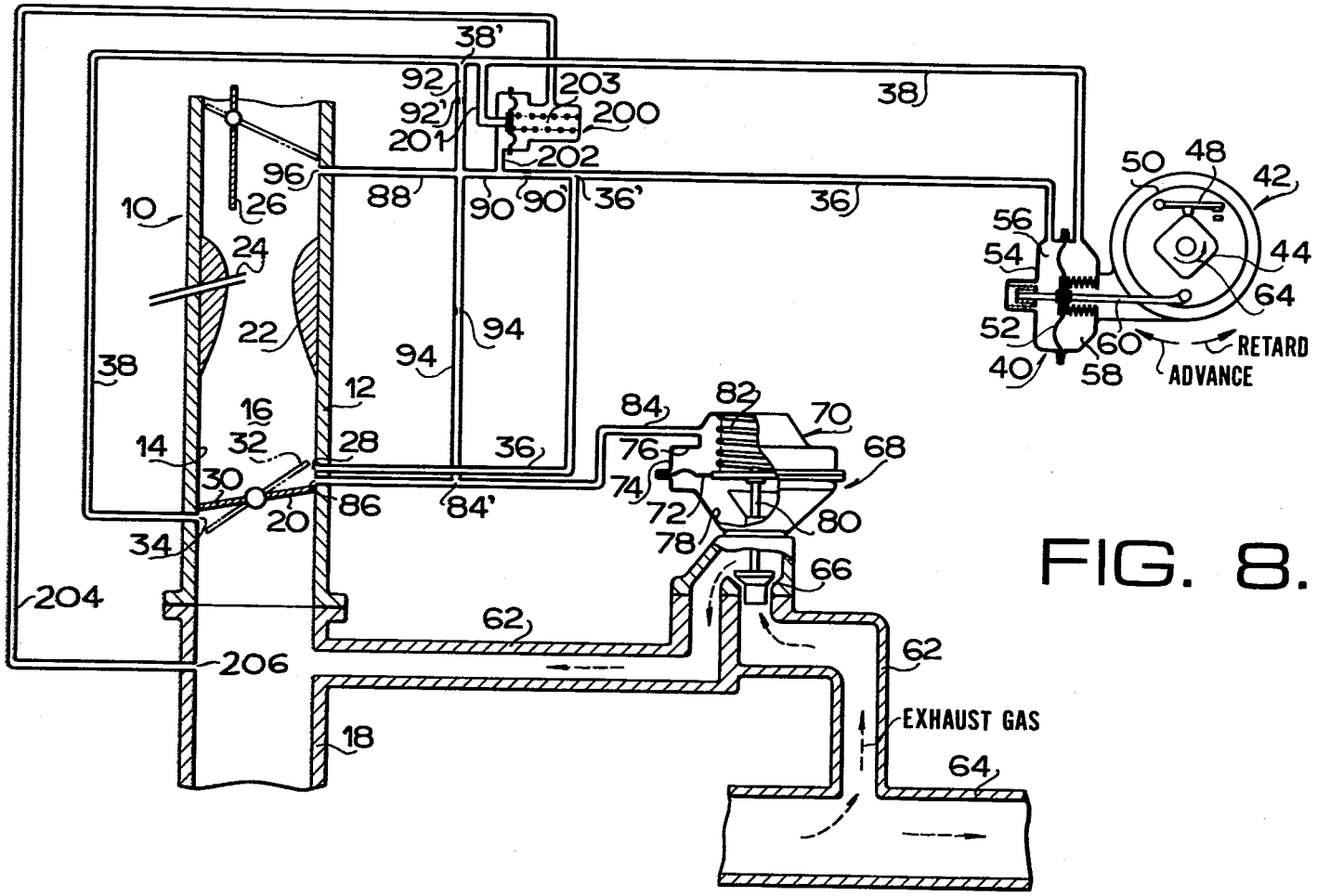

FIGS. 5*a*, 5*b* and 5*c* are exploded views of the apparatus shown in FIG. 3 as viewed through lines II—II, III—III and IV—IV;

FIGS. 6*a*, 6*b* and 6*c* are similar exploded views showing a modification of the apparatus shown in FIG. 3;

FIGS. 7*a*, 7*b* and 7*c* are similar exploded views showing another modification of the apparatus shown in FIG. 3; and FIG. 8 is a view similar to FIG. 1 but shows still another preferred embodiment of an exhaust emission control system according to the present invention.

Referring particularly to the accompanying drawings, like reference numerals are used throughout all Figures to designate like parts.

Referring to FIG. 1 of the accompanying drawings, a portion 10 of a carburetor is illustrated. The carburetor is provided with a main body portion 12 having a cylindrical bore 14 providing a conventional intake passageway 16. The latter is connected to a conventional intake manifold 18, from which air and fuel mixture passes to the engine cylinders, not shown, in a known manner.

The flow of air and fuel mixture through the intake passageway 16 is controlled by a conventional throttle valve 20. A conventional venturi section 22 is provided above the throttle valve 20 and a conventional fuel nozzle 24 opens at the venturi section 22 to induce fuel into the intake passageway 16 above the throttle valve 20 in a known manner. A conventional choke valve 26 is mounted adjacent the inlet of the intake passageway 16 to control the amount of air flowing into the passageway 16.

The main body portion 12 of the carburetor 10 has a port 28 formed at a location adjacent to, and on the upstream side of the throttle valve 20 when the throttle valve 20 is closed in idle speed position 30 and on the downstream side of the throttle valve 20 when the throttle valve is rotated to its partly opened position 32 as shown by a phantom line in FIG. 1. The carburetor 10 also has a port 34 formed at a location adjacent to, and on the downstream side of the throttle valve 20 when the throttle valve 20 is in the idle speed position 30 and on the upstream side of the throttle valve 20 when the throttle valve is partly opened as shown by the dotted line 32. A vacuum conduit 36 and a vacuum conduit 38 are connected to a vacuum actuator 40 of the double action type in a distributor 42. The vacuum to the conduit 36 is supplied from the port 28, while the vacuum to the conduit 38 is supplied from the port 34.

The distributor 42 includes a usual cam 44 which rotates in a direction indicated by an arrow 46. The cam 44 operates a conventional circuit breaker 48 mounted on a breaker plate 50 which can be rotated clockwise to advance the spark timing and counterclockwise to retard the spark timing by the vacuum actuator 40. The vacuum actuator 40 comprises a flexible diaphragm 52 mounted in a casing 54. The diaphragm 52 divides the casing 54 into a vacuum chamber 56 to which the vacuum conduit 36 is connected and into a vacuum chamber 58 to which the vacuum conduit 38 is connected. A plunger 60 is secured at one end to the diaphragm 52 and pivoted at the opposite end to the breaker plate 50 so as to advance the spark timing when the plunger 60 moves to the left and to retard the spark timing when the plunger moves to the right. Thus the chamber 56 is often referred to as "spark advance chamber", while the chamber 58 as "spark retard chamber".

To recirculate a portion of exhaust gases into the intake manifold 18, an exhaust gas recirculation conduit 62 leads from an exhaust pipe 64 to the intake manifold 18, in a known manner.

The recirculation conduit 62 is normally closed by a valve 66 of a conventional exhaust gas recirculation control device 68 having a vacuum actuator 70 for opening the normally closed valve 66. The vacuum actuator 70 has a spring loaded diaphragm 72 mounted in a casing 74 to divide the casing 74 into an upper vacuum chamber 76 and a lower atmosphere pressure chamber 78. A valve stem 80 has one end secured to the diaphragm 72 and the opposite end secured to a valve element of the valve 66. A spring 82 in the vacuum chamber 76 biases the diaphragm 72 downwardly, causing the valve 66 to close the exhaust gas recirculation conduit 62. A vacuum conduit 84 is connected to the vacuum chamber 76 of the vacuum actuator 70. The vacuum to the conduit 84 is supplied from a port 86 that opens to the intake passageway 16 at a location adjacent to, and on the upstream side of the throttle valve 20 when the throttle valve 20 is closed in idle speed position 30 and on the downstream side of the throttle valve 20 when the throttle valve is partly opened to the dotted line position 32.

In accordance with the teaching of the present invention, the vacuum in the vacuum conduit 36 is modulated by bleeding air through a suitable opening 36' in the conduit 36 per se, the vacuum in the vacuum conduit 38 is modulated by bleeding air through a suitable opening 38' in the conduit 38 per se, and the vacuum in the vacuum conduit 84 is modulated by bleeding air through a suitable opening 84'. The air bleeding means comprises an atmospheric pressure conduit 88 and three branch conduits 90, 92 and 94 from the atmosphere conduit 88. The branch conduits 90, 92 and 94 open to the vacuum conduits 36, 38 and 84, respectively, through their openings 36', 38' and 84'. Each of the conduits 90, 92 and 94 is provided with a restricting means such as an orifice. The conduits 90, 92 and 94 include restrictors or orifices 90', 92' and 94', respectively. Preferably, the atmopheric conduit 88 communicates with the intake passageway 16 at a port 96 on the upstream side of the venturi section 22. The atmospheric conduit 88 may communicate with an air cleaner of the engine or may directly open to the ambient atmosphere through a suitable filter.

The operation of the system illustrated in FIG. 1 is as follows.

When the throttle valve 20 is closed in the idle position 30, the vacuum is supplied to the vacuum conduit 38 through the port 34. The vacuum is therefore imposed to the spark retard chamber 58 of the vacuum actuator through the vacuum conduit 38, thereby rotating the breaker plate 50 in a direction to retard the spark timing. When the throttle valve 20 is partly opened to the position 32, the vacuum at the port 34 decreases and approaches the atmospheric pressure and the vacuum develops at the ports 28 and 86. When the throttle valve 20 is opened wider than the partly opened position 32 for acceleration, the vacuum is supplied to the vacuum conduit 36 through the port 28 and the vacuum to the vacuum conduit 84 through the port 86. The vacuum is therefore imposed to the spark advance chamber 56 of the vacuum actuator 40, thereby rotating the breaker plate 50 in a direction to advance the spark timing, while the vacuum is imposed to the vacuum chamber 76 of the vacuum actuator 70 of the exhaust gas recirculation control device 68, effecting the exhaust gas recirculation.

From the preceding description of the system illustrated in FIG. 1, it should be noted that in accordance with the present invention the system characteristics may be modulated easily by varying the effective cross sectional area of each of the orifices 90', 92' and 94' in the air bleeding means.

Figure 2:
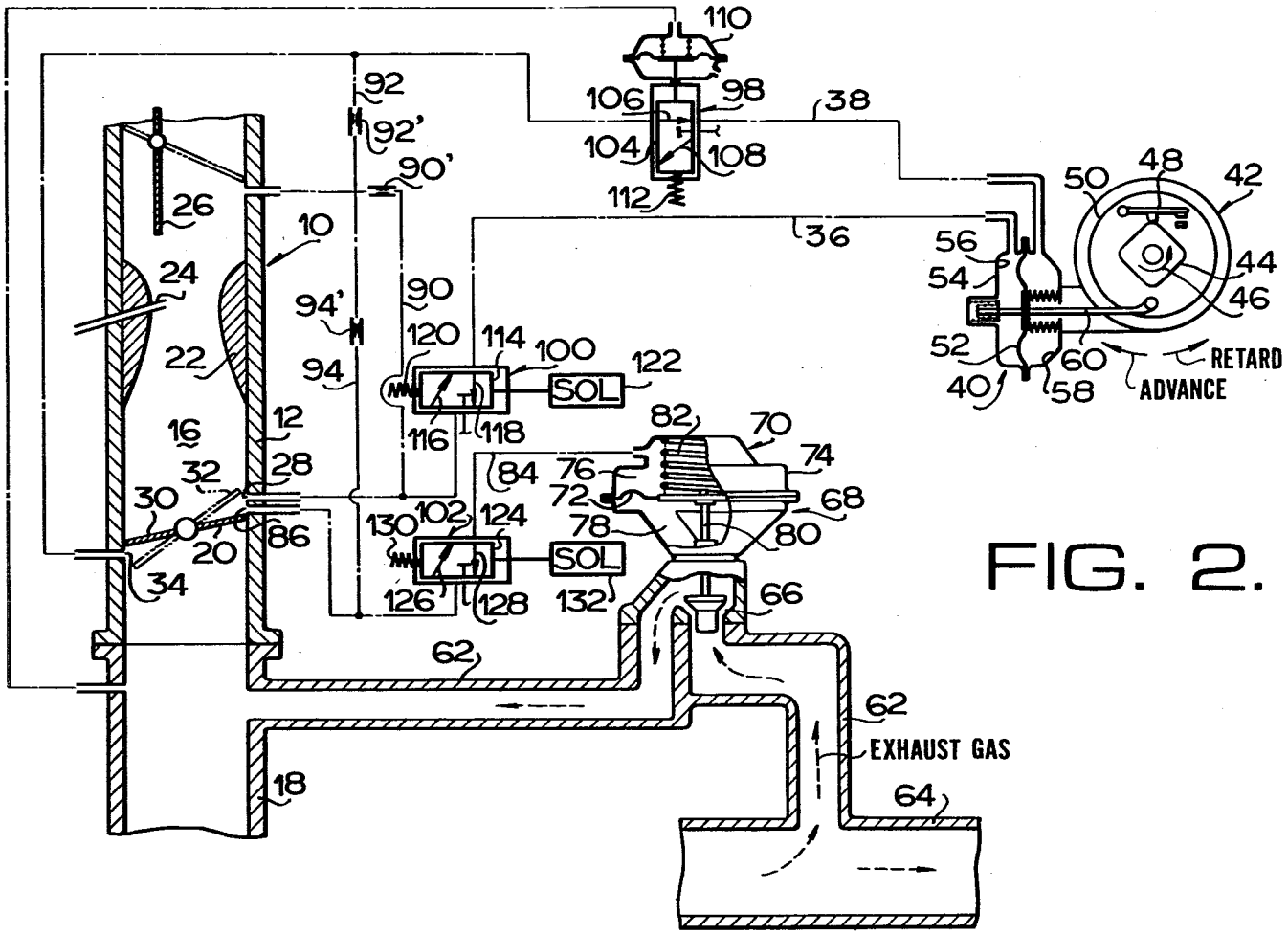
FIG. 2 is a similar view to FIG. 1 showing another preferred embodiment of an exhaust emission control system embodying the present invention.

Referring to FIG. 2, the system shown herein is similar to that shown in FIG. 1 except that there are provided a first valve means 98 for venting the vacuum conduit 38 and the spark retard chamber 58 during deceleration of the engine; a second valve means 100 for venting the vacuum conduit 36 and the spark advance chamber 56 during engine operation at low engine speeds; and a third valve means 102 for venting the vacuum conduit 84 and the vacuum chamber 76 during engine operation at low engine temperature.

The valve 98 is provided with a slidable valve 104 having a straight through passage 106 and a vent passage 108. A vacuum servo or actuator 110 is connected to the intake manifold 18 and actuated by the intake manifold vacuum. A spring 112 positions the valve 104 as shown to connect port 34 to the chamber 58 through the vacuum conduit 38 when the vacuum servo 110 is deactuated. The vacuum servo or actuator 110 is actuated when the intake manifold vacuum is higher than a predetermined reference intake manifold vacuum. The vacuum servo or actuator 110 when actuated moves the valve 104 to vent the conduit 38.

The valve 100 is provided with a slidable valve 114 having a straight through passage 116 and a vent passage 118. A spring 120 positions the valve 114 as shown to vent vacuum conduit 36 when a solenoid 122 is deenergized. The solenoid 122 when energized moves the valve 114 to connect the port 28 to the chamber 56 through the conduit 36. The solenoid 122 is connected to an engine speed responsive switch of the normally open type, not shown, which is closed when the engine speed is higher than a predetermined reference engine speed. Thus, the solenoid 122 is energized when the engine speed is higher than the predetermined reference engine speed.

The valve 102 is provided with a slidable valve 124 having a straight through passage 126 and a vent passage 128.

A spring 130 positions the valve 124 as shown to vent vacuum conduit 84 when a solenoid 132 is deenergized. The solenoid 132 when energized moves the valve 124 to connect port 86 to vacuum chamber 76 of a recirculation control device 68. The solenoid 132 is connected to an engine temperature responsive switch of normally open type, not shown, which is closed when the engine temperature is higher than a predetermined reference temperature. Thus, the solenoid 132 is energized when the engine temperature is higher than the predetermined reference temperature. It should be noted that the engine temperature is represented by the temperatures of various parts or components of the engine such as coolant, oil, etc. or the temperature of the cylinder wall of the engine.

The operation of the system shown in FIG. 2 is as follows.

When throttle valve 20 is closed in idle position 30, the vacuum is imposed to the spark retard chamber 58, biasing breaker plate 50 toward spark retard position because the valve 104 is positioned as shown. At idle engine speed, the spark advance chamber 56 is vented because the valve 114 is positioned as shown. When the throttle valve 20 is opened wider than the partly opened position 32 for acceleration, the vacuum at the port 34 approaches the atmospheric pressure, while the vacuum develops at the ports 28 and 86. If, now, the engine speed exceeds the predetermined reference engine speed and the engine temperature is higher than the predetermined reference temperature, the solenoid 122 moves the valve 114 to a position to connect the port 28 to the conduit 36 and the solenoid 132 moves the valve 124 to a position to connect the port 86 to the conduit 84. As a result, the spark timing is advanced and the exhaust recirculation is effected.

In the air bleeding means shown in FIGS. 1 or 2 three orifices 90', 92' and 94' are disposed in the branch conduits 90, 92 and 94, respectively. An air bleed apparatus, generally denoted by 134, which can replace the air bleeding means shown in FIGS. 1 or 2 is illustrated in FIGS. 3, 4, 5*a*, 5*b* and 5*c*.

The air bleed apparatus 134 comprises a first base plate 136, a control plate 138 and a second base plate 140. The first base plate 136 is formed with grooves 142, 144 and 146 as shown in FIG. 5*a*. The control plate 138 is joined face to face to the first base plate 136 to cover the grooves 142, 144 and 146 to form conduits that are connected to and form parts of the vacuum conduit 38, 36 and 84, respectively (see FIGS. 4, 5*a* and 5*b*). The control plate 138 is formed with restrictors or orifice openings 148, 150 and 152 (see FIG. 5*b*) that are positioned in alignment with the grooves 142, 144 and 146, respectively. The second base plate 140 is joined face to face to the control plate 138. The base plate 140 is formed with a vent hole 154 which preferably communicates with the atmosphere through an air filter (not shown) or which may communicate with the intake passageway 16 at a port 96 on the inlet side of the venturi section 22 (see FIGS. 1 or 2), and is formed with grooves 158, 160 and 162 diverging from the vent hole 154. The grooves 158, 160 and 162 are disposed in alignment with the orifice openings 148, 150 and 152, respectively. The plates 136, 138 and 140 are joined face to face one after another as shown in FIGS. 3 or 4 by a plurality of bolts 164.

It should be understood that air bleeds into the vacuum conduit 38 through the vent port 154, groove 158, orifice hole 148, that air bleeds into the vacuum conduit 36 through the vent hole 154, groove 160 and orifice hole 150, and that air bleeds into the vacuum conduit 84 through the vent hole 154, groove 162 and orifice hole 152. It should be appreciated that the orifice size can be varied by replacing the control plate 138 with another one.

Referring to FIGS. 6*a*, 6*b* and 6*c*, an air bleed apparatus shown herein is different from the preceding apparatus (shown in FIGS. 3, 4, 5*a*, 5*b* and 5*c*) in that a control plate 138 (see FIG. 6*b*) is formed with restrictors or orifice holes 166 and 168 positioned in alignment with grooves 144 and 146, respectively, and a second base plate 140 is formed with a recessed portion 170 disposed in alignment with the orifice holes 166 and 168. It should be noted that air bleeds into a groove 146 in flow communication with a vacuum conduit 84 through a vent port 154, groove 160 (see FIG. 6*c*), orifice hole 150, groove 144 (see FIG. 6*a*), orifice hole 166, recessed portion 170, orifice hole 168. With this internal fluid connection fluid leakage will be more effectively prevented.

Referring to FIGS. 7*a*, 7*b* and 7*c*, an air bleed apparatus is used as a part of an exhaust gas recirculation conduit. A first base plate 136 is formed with a groove 172 having one end closed. A control plate 138 is formed with two restrictor or orifice holes 174 and 176 disposed in alignment with groove 146 and groove 172, respectively. A second base plate 140 is formed with a groove diverging from a vent hole 154 and disposed in alignment with the orifice hole 176. A portion of exhaust gas flowing through the exhaust gas recirculation conduit 146 passes through the orifice hole 174, groove 162, groove 178, orifice hole 176 and groove 172 into the intake passageway right below the engine air cleaner.

FIG. 8 illustrates still another embodiment of an exhaust emission control system embodying the present invention. This illustrated embodiment is similar to FIG. 1 except that a vacuum control valve 200 is connected between the vacuum conduits 36 and 38. The vacuum control valve 200 is comprised of a casing in which a flexible diaphragm is disposed and divides the casing into an atmospheric chamber and a vacuum chamber 203. The vacuum control valve 200 includes a first conduit 201 connected at its one end to the vacuum conduit 38. Another end of the conduit 201 projects into the atmospheric chamber and is opened or closed by the diaphragm. A second conduit 202 is connected at its one end to the atmospheric chamber of the vacuum control valve 200 and connected at its another end to the vacuum conduit 36 at a position upstream of the orifice 90'. The fluid communication between the first and second conduit 201 and 202 is controlled by intake manifold vacuum admitted to the vacuum chamber of the vacuum control valve 200 in which a spring means is disposed for normally urging the diaphragm to a position to interrupt fluid communication between the first and second conduits 201 and 202. To this end, the vacuum chamber of the vacuum control valve 200 is connected to a third conduit 204 communicating with a port 206 opening to the intake manifold 18. During decelerating condition of the engine, if the intake manifold vacuum exceeds a predetermined level, the diaphragm of the vacuum control valve 200 is moved rightward as viewed in FIG. 8 thereby providing fluid communication between the first and second conduits 201 and 202. In this condition, the vacuum in the vacuum conduit 38 is bled through the first and second conduits 201 and 202 into the conduit 88 so that the vacuum to be applied to the spark retard chamber 58 of the vacuum actuator 40 is decreased to a lower level thereby preventing the braker plate 50 from being rotated to a position to excessively retard the spark timing during decelerating operating condition of the engine for thereby improving the combustion efficiency of the engine.

While the present invention has been shown and described with reference to specific preferred embodiments, it should be noted that various changes or modifications may be made without departing from the scope of the present invention.

What is claimed is:

1. An internal combustion engine, comprising an intake passageway having a throttle valve, an exhaust pipe operatively communicating with said intake passageway downstream of the latter via the engine, a distributor, a vacuum actuator including a first diaphragm means defining an advance chamber and a retard chamber, said first diaphragm means being operatively connected to said distributor for controlling spark timing, an exhaust gas recirculation system further operatively communicating said exhaust pipe to said intake passageway at a point of the latter downstream of said throttle valve, said exhaust gas recirculation system comprising, a recirculation control valve means for opening and closing, respectively, communication of said exhaust pipe with said intake passageway via said exhaust gas recirculation system, a second diaphragm means operatively connected to said recirculation control valve means for controlling the latter, said second diaphragm means defining a vacuum chamber, and a spring means for biasing said second diaphragm means so as to close said recirculation control valve means, a first conduit communicating said advance chamber with said intake passageway adjacent said throttle valve at an upstream side of said throttle valve when said throttle valve is closed in idle position and at a downstream side of said throttle valve when the throttle valve is partly opened, respectively, a second conduit communicating said retard chamber with said intake passageway adjacent said throttle valve at the downstream side of said throttle valve when said throttle valve is closed in idle position and at the upstream side of said throttle valve when the throttle valve is partly opened, respectively, a third conduit communicating said vacuum chamber of said exhaust gas recirculation system with said intake passageway adjacent said throttle valve at the upstream side of said throttle valve when said throttle valve is closed, a first branch conduit communicating said first conduit with atmosphere, a second branch conduit communicating said second conduit with atmosphere, a third branch conduit communicating said third conduit with atmosphere, and a flow restricting means provided in each of said branch conduits for restricting flow therethrough, respectively, all said flow restricting means being constructed as a single unit and replaceably mounted with respect to said branch conduits, respectively.

2. An internal combustion engine as claimed in claim 1, wherein said intake passageway includes a venturi section, each of said branch conduits communicates with said intake passageway at the upstream side of said venturi section in said intake passageway.

3. An internal combustion engine, comprising an intake passageway having a throttle valve, an exhaust pipe operatively communicating with said intake passageway downstream of the latter via the engine, a distributor, a vacuum actuator including a first diaphragm means defining an advance chamber and a retard chamber, said first diaphragm means being operatively connected to said distributor for controlling spark timing, an exhaust gas recirculation system further operatively communicating said exhaust pipe to said intake passageway at a point of the latter downstream of said throttle valve, said exhaust gas recirculation system comprising, a recirculation control valve means for opening and closing, respectively, communication of said exhaust pipe with said intake passageway via said exhaust gas recirculation system, a second diaphragm means operatively connected to said recirculation control valve means for controlling the latter, said second diaphragm means defining a vacuum chamber, and a spring means for biasing said second diaphragm means so as to close said recirculation control valve means, a first conduit communicating said advance chamber with said intake passageway adjacent said throttle valve at an upstream side of said throttle valve when said throttle valve is closed in idle position and at a downstream side of said throttle valve when said throttle valve is partly opened, respectively, a second conduit communicating said retard chamber with said intake passageway adjacent said throttle valve at the downstream side of said throttle valve when said throttle valve is closed in idle position and at the upstream side of said throttle valve when said throttle valve is partly opened, respectively, a third conduit communicating said vacuum chamber of said exhaust gas recirculation system with said intake passageway adjacent said throttle valve at the upstream side of said throttle valve when said throttle valve is closed, a first branch conduit communicating said first conduit with atmosphere, a second branch conduit communicating said second conduit with atmosphere, a third branch conduit communicating said third conduit with atmosphere, and a flow restricting means provided in each of said branch conduits for restricting flow therethrough, respectively, all of said flow restricting means together comprising a first plate having a face with three grooves, a second plate abuttingly joined against said face of said first plate covering said three grooves forming conduits therethrough, respectively, the latter being connected to and constituting portions of said first, second and third conduits, respectively, said second plate being formed with orifice means positioned in communicating alignment with said grooves, respectively, and a third plate abuttingly joined to said second plate, said third plate is formed with a hole therethrough and with grooves diverging from said hole and in communicating alignment with said orifice means, respectively, the latter-mentioned grooves being covered by said second plate to form channels constituting portions of said branch conduits, respectively, communicating with said orifice means, respectively.

4. An internal combustion engine as claimed in claim 3, wherein said intake passageway includes a venturi section, said hole of said third plate communicates with said intake passageway at the upstream side of said venturi section of said intake passageway.

5. An internal combustion engine, comprising an intake passageway having a throttle valve, an exhaust pipe operatively communicating with said intake passageway downstream of the latter via the engine, a distributor, a vacuum actuator including a first diaphragm means defining an advance chamber and a retard chamber, said first diaphragm means being operatively connected to said distributor for controlling spark timing, an exhaust gas recirculation system further operatively communicating said exhaust pipe to said intake passageway at a point of the latter downstream of said throttle valve, said exhaust gas recirculation system comprising, a recirculation control valve means for opening and closing, respectively, communication of said exhaust pipe with said intake passageway via said exhaust gas recirculation system, a second diaphragm means operatively connected to said recirculation control valve means for controlling the latter, said second diaphragm means defining a vacuum chamber, and a spring means for biasing said second diaphragm means so as to close said recirculation control valve means, a first conduit communicating said advance chamber with said intake passageway adjacent said throttle valve at an upstream side of said throttle valve when said throttle valve is closed in idle position and at a downstream side of said throttle valve when said throttle valve is partly opened, respectively, a second conduit communicating said retard chamber with said intake passageway adjacent said throttle valve at the downstream side of said throttle valve when said throttle valve is closed in idle position and at the upstream side of said throttle valve when said throttle valve is partly opened, respectively, a third conduit communicating said vacuum chamber of said exhaust gas recirculation system with said intake passageway adjacent said throttle valve at the upstream side of said throttle valve when said throttle valve is closed, another valve means communicating with said second conduit for venting said second conduit in response to a vacuum in said intake passageway higher than a predetermined reference intake manifold vacuum, a first branch conduit communicating said first conduit with atmosphere, a second branch conduit communicating said second conduit with atmosphere, a third branch conduit communicating said third conduit with atmosphere, and a flow restricting means provided in each of said branch conduits for restricting flow therethrough, respectively, all said flow restricting means being constructed as a single unit and replaceably mounted with respect to said branch conduits, respectively.

6. An internal combustion engine, comprising an intake passageway having a throttle valve, an exhaust pipe operatively communicating with said intake passageway downstream of the latter via the engine, a distributor, a vacuum actuator including a first diaphragm means defining an advance chamber and a retard chamber, said first diaphragm means being operatively connected to said distributor for controlling spark timing, an exhaust gas recirculation system further operatively communicating said exhaust pipe to said intake passageway at a point of the latter downstream of said throttle valve, said exhaust gas recirculation system comprising, a recirculation control valve means for opening and closing, respectively, communication of said exhaust pipe with said intake passageway via said exhaust gas recirculation system, a second diaphragm means operatively connected to said recirculation control valve means for controlling the latter, said second diaphragm means defining a vacuum chamber, and a spring means for biasing said second diaphragm means so as to close said recirculation control valve means, a first conduit communicating said advance chamber with said intake passageway adjacent said throttle valve at an upstream side of said throttle valve when said throttle valve is closed in idle position and at a downstream side of said throttle valve when said throttle valve is partly opened, respectively, a second conduit communicating said retard chamber with said intake passageway adjacent said throttle valve at the downstream side of said throttle valve when said throttle valve is closed in idle position and at the upstream side of said throttle valve when said throttle valve is partly opened, respectively, a third conduit communicating said vacuum chamber of said exhaust gas recirculation system with said intake passageway adjacent said throttle valve at the upstream side of said throttle valve when said throttle valve is closed, a first valve means fluidly disposed in said second conduit at a position intermediate said intake passageway and said retard chamber of said vacuum actuator for venting said second conduit in response to vacuum in said intake passageway greater than a predetermined reference intake manifold vacuum, a second valve means fluidly disposed in said first conduit intermediate said intake passageway and said advance chamber of said vacuum actuator for venting said first conduit in response to engine speeds lower than a predetermined reference engine speed, a third valve means fluidly disposed in said third conduit intermediate said intake passageway and said vacuum chamber of said exhaust gas recirculation system for venting said third conduit in response to engine temperatures lower than a predetermined reference engine temperature, a first branch conduit communicating said first conduit with atmosphere, a second branch conduit communicating said second conduit with atmosphere, a third branch conduit communicating said third conduit with atmosphere, and a flow restricting means provided in each of said branch conduits for restricting flow therethrough, respectively, all said flow restricting means being constructed as a single unit and replaceably mounted with respect to said branch conduits, respectively.

7. An internal combustion engine, comprising an intake passageway having a throttle valve, an exhaust pipe operatively communicating with said intake passageway downstream of the latter via the engine, a distributor, a vacuum actuator including a first diaphragm means defining an advance chamber and a retard chamber, said first diaphragm means being operatively connected to said distributor for controlling spark timing, an exhaust gas recirculation system further operatively communicating said exhaust pipe to said intake passageway at a point of the latter downstream of said throttle valve, said exhaust gas recirculation system comprising, a recirculation control valve means for opening and closing, respectively, communication of said exhaust pipe with said intake passageway via said exhaust gas recirculation system, a second diaphragm means operatively connected to said recirculation control valve means for controlling the latter, said second diaphragm means defining a vacuum chamber, and a spring means for biasing said second diaphragm means so as to close said recirculation control valve means, a first conduit communicating said advance chamber with said intake passageway adjacent said throttle valve at an upstream side of said throttle valve when said throttle valve is closed in idle position and at a downstream side of said throttle valve when said throttle valve is partly opened, respectively, a second conduit communicating said retard chamber with said intake passageway adjacent said throttle valve at the downstream side of said throttle valve when said throttle valve is closed in idle position and at the upstream side of said throttle valve when said throttle valve is partly opened, respectively, a third conduit communicating said vacuum chamber of said exhaust gas recirculation system with said intake passageway adjacent said throttle valve at the upstream side of said throttle valve when said throttle valve is closed, a first valve means fluidly disposed in said second conduit at a position intermediate said intake passageway and said vacuum actuator for venting said second conduit in response to vacuum in said intake passageway greater than a predetermined reference intake manifold vacuum, a second valve means fluidly disposed in said first conduit intermediate said intake passageway and said vacuum actuator for venting said first conduit in response to engine speeds lower than a predetermined reference engine speed, a third valve means fluidly disposed in said third conduit intermediate said intake passageway and said vacuum chamber of said exhaust gas recirculation system for venting said third conduit in response to engine temperatures lower than a predetermined reference engine temperature, a first branch conduit communicating said first conduit with atmosphere, a second branch conduit communicating said second conduit with atmosphere, a third branch conduit communicating said third conduit with atmosphere, and a flow restricting means provided in each of said branch conduits for restricting flow therethrough, respectively, all of said flow restricting means together comprising a first plate having a face with three grooves, a second plate abuttingly joined against said face of said first plate covering said three grooves forming conduits therethrough, respectively, the latter being connected to and constituting portions of said first, second and third conduits, respectively, said second plate being formed with orifice means positioned in communicating alignment with said grooves, respectively, and a third plate abuttingly joined to said second plate, said third plate is formed with a hole therethrough and with grooves diverging from said hole and in communicating alignment with said orifice means, respectively, the latter-mentioned grooves being covered by said second plate to form channels constituting portions of said branch conduits, respectively, communicating with said orifice means, respectively.

8. An internal combustion engine, comprising an intake passageway having a throttle valve, an exhaust pipe operatively communicating with said intake passageway downstream of the latter via the engine, a distributor, a vacuum actuator including a first diaphragm means defining an advance chamber and a retard chamber, said first diaphragm means being operatively connected to said distributor for controlling spark timing, an exhaust gas recirculation system further operatively communicating said exhaust pipe to said intake passageway at a point of the latter downstream of said throttle valve, said exhaust gas recirculation system comprising, a recirculation control valve means for opening and closing, respectively, communication of said exhaust pipe with said intake passageway via said exhaust gas recirculation system, a second diaphragm means operatively connected to said recirculation control valve means for controlling the latter, said second diaphragm means defining a vacuum chamber, and a spring means for biasing said second diaphragm means so as to close said recirculation control valve means, a first conduit communicating said advance chamber with said intake passageway adjacent said throttle valve at an upstream side of said throttle valve when said throttle valve is closed in idle position and at a downstream side of said throttle valve when said throttle valve is partly opened, respectively, a second conduit communicating said retard chamber with said intake passageway adjacent said throttle valve at the downstream side of said throttle valve when said throttle valve is closed in idle position and at the upstream side of said throttle valve when said throttle valve is partly opened, respectively, a third conduit communicating said vacuum chamber of said exhaust gas recirculation system with said intake passageway adjacent said throttle valve at the upstream side of said throttle valve when said throttle valve is closed, a first valve means fluidly disposed in said second conduit intermediate said intake passageway and said vacuum actuator, a vacuum actuator means communicating with said intake passageway downstream of said throttle valve for operating said first valve means for venting said second conduit in response to an intake passageway vacuum greater than a predetermined reference vacuum, a second valve means fluidly disposed in said first conduit intermediate said intake passageway and said vacuum actuator for venting said first conduit in response to engine speeds lower than a predetermined reference engine speed, a third valve means fluidly disposed in said third conduit intermediate said intake passageway and said vacuum chamber of said exhaust gas recirculation system for venting said third conduit in response to engine temperatures lower than a predetermined reference engine temperature, a first branch conduit communicating said first conduit with atmosphere, a second branch conduit communicating said second conduit with atmosphere, a third branch conduit communicating said third conduit with atmosphere, and a flow restricting means provided in each of said branch conduits for restricting flow therethrough, respectively, all of said flow restricting means together comprising a first plate having a face with three grooves, a second plate abuttingly joined against said face of said first plate covering said three grooves forming conduits therethrough, respectively, the latter being connected to and constituting portions of said first, second and third conduits, respectively, said second plate being formed with orifice means positioned in communicating alignment with said grooves, respectively, and a third plate abuttingly joined to said second plate, said third plate is formed with a hole therethrough and with grooves diverging from said hole and in communicating alignment with said orifice means, respectively, the latter-mentioned grooves being covered by said second plate to form channels constituting portions of said branch conduits, respectively, communicating with said orifice means, respectively.

9. An internal combustion engine, comprising an intake passageway having a throttle valve and a choke valve, an exhaust pipe operatively communicating with said intake passageway downstream of the latter via the engine, a distributor, a vacuum actuator including a first diaphragm means defining an advance chamber and a retard chamber, said first diaphragm means being operatively connected to said distributor for controlling spark timing, an exhaust gas recirculation system further operatively communicating said exhaust pipe to said intake passageway at a point of the latter downstream of said throttle valve, said exhaust gas recirculation system comprising, a recirculation control valve means for opening and closing, respectively, communication of said exhaust pipe with said intake passageway via said exhaust gas recirculation system, a second diaphragm means operatively connected to said recirculation control valve means for controlling the latter, said second diaphragm means defining a vacuum chamber, and a spring means for biasing said second diaphragm means so as to close said recirculation control valve means, a first conduit communicating said advance chamber with said intake passageway adjacent said throttle valve at an upstream side of said throttle valve when said throttle valve is closed in idle position and at a downstream side of said throttle valve when the throttle valve is partly opened, respectively, a second conduit communicating said retard chamber with said intake passageway adjacent said throttle valve at the downstream side of said throttle valve when said throttle valve is closed in idle position and at the upstream side of said throttle valve when said throttle valve is partly opened, respectively, a third conduit communicating said vacuum chamber of said exhaust gas recirculation system with said intake passageway adjacent said throttle valve at the upstream side of said throttle valve when said throttle valve is closed, a first branch conduit connected to said first conduit, a second branch conduit connected to said second conduit, a third branch conduit connected to said third conduit, a flow restricting means provided in each of said branch conduits for restricting flow therethrough, respectively, all of said flow restricting means being constructed as a single unit and replaceably mounted with respect to said branch conduits, respectively, and a common conduit communicating said first, second and third branch conduits with said intake passageway at a downstream side of said choke valve when said choke valve is closed.

10. An internal combustion engine, comprising an intake passageway having a throttle valve and a choke valve, an exhaust pipe operatively communicating with said intake passageway downstream of the latter via the engine, a distributor, a vacuum actuator including a first diaphragm means defining an advance chamber and a retard chamber, said first diaphragm means being operatively connected to said distributor for controlling spark timing, an exhaust gas recirculation system further operatively communicating said exhaust pipe to said intake passageway at a point of the latter downstream of said throttle valve, said exhaust gas recirculation system comprising, a recirculation control valve means for opening and closing, respectively, communication of said exhaust pipe with said intake passageway via said exhaust gas recirculation system, a second diaphragm means operatively connected to said recirculation control valve means for controlling the latter, said second diaphragm means defining a vacuum chamber, and a spring means for biasing said second diaphragm means so as to close said recirculation control valve means, a first conduit communicating said advance chamber with said intake passageway adjacent said throttle valve at an upstream side of said throttle valve when said throttle valve is closed in idle position and at a downstream side of said throttle valve when the throttle valve is partly opened, respectively, a second conduit communicating said retard chamber with said intake passageway adjacent said throttle valve at the downstream side of said throttle valve when said throttle valve is closed in idle position and at the upstream side of said throttle valve when said throttle valve is partly opened, respectively, a third conduit communicating said vacuum chamber of said exhaust gas recirculation system with said intake passageway adjacent said throttle valve at the upstream side of said throttle valve when said throttle valve is closed, a first branch conduit connected to said first conduit, a second branch conduit connected to said second conduit, a third branch conduit connected to said third conduit, a flow restricting means provided in each of said branch conduits for restricting flow therethrough, respectively, all of said flow restricting means together comprising a first plate having a face with three grooves, a second plate abuttingly joined against said face of said first plate covering said three grooves forming conduits therethrough, respectively, the latter being connected to and constituting portions of said first, second and third conduits, respectively, said second plate being formed with orifice means positioned in communicating alignment with said grooves, respectively, and a third plate abuttingly joined to said second plate, said third plate is formed with a hole therethrough and with grooves diverging from said hole and in communicating alignment with said orifice means, respectively, the latter-mentioned grooves being covered by said second plate to form channels constituting portions of said branch conduits, respectively, communicating with said orifice means, respectively, and a common conduit connected to said hole of said third plate communicating said first, second and third branch conduits with said intake passageway at a downstream side of said choke valve when said choke valve is closed.

* * * * *